United States Patent [19]

Hellbusch

[11] Patent Number: 5,076,372

[45] Date of Patent: Dec. 31, 1991

[54] UNDER FRAME MOUNTED SOIL SAMPLER FOR LIGHT TRUCKS

[76] Inventor: Jim A. Hellbusch, 2106 Maple Rd., Columbus, Nebr. 68601

[21] Appl. No.: 232,789

[22] Filed: Aug. 15, 1988

[51] Int. Cl.[5] ..... F21B 49/02; G01N 1/08

[52] U.S. Cl. ..... 175/20; 73/864.43; 175/49; 175/58; 280/762

[58] Field of Search ..... 175/20, 49, 58, 203, 175/308; 280/762, 763.1, 769, 416.1; 73/864.43, 864.45, 864.31; 172/21, 22

[56] References Cited

U.S. PATENT DOCUMENTS

| | | | |
|---|---|---|---|
| 3,464,504 | 9/1969 | Stange | 175/58 X |
| 4,284,150 | 8/1981 | Davis | 175/20 X |
| 4,685,339 | 8/1987 | Philipenko | 175/20 X |
| 4,828,047 | 5/1989 | Rogerson | 175/58 X |

*Primary Examiner*—David J. Bagnell
*Attorney, Agent, or Firm*—John A. Beehner

[57] ABSTRACT

An under frame tool bar attachment, for a light truck with a frame having a pair of generally parallel spaced apart frame side bars, includes an elongated tool bar, a pair of mounting assemblies, each adapted for securing the tool bar to a respective one of the frame side bars in transversely extended relation across the underside of the light truck frame and fasteners for securing the mounting assemblies to the truck frame and the tool bar to the mounting assemblies. The under frame mounted soil sampler includes an upright outer mast supported on the tool bar, a stabilizer for transversely stabilizing the upper end of the outer mast relative to the light truck box, a drill head vertically moveable on the outer mast, a power source for raising and lowering the drill head and a soil sampler tool removably carried on the drill head.

25 Claims, 7 Drawing Sheets

UNDER FRAME MOUNTED SOIL SAMPLER FOR LIGHT TRUCKS

BACKGROUND OF THE INVENTION

The present invention is directed generally to an under frame tool bar attachment for a light truck and more particularly to an under frame mounted soil sampler for a light truck, which sampler is operative for quickly, easily and efficiently taking soil samples from even hard frozen ground.

Soil samplers are needed for testing the soil in farm fields to provide evidence of compliance with regulations relating to additive residues and to assist with determinations of fertilizer requirements, for example. Soil samplers are also used for testing soil in connection with site selection for building construction. Soil samplers have previously been mounted either in the cab of a truck or on a frame mounted on the top of the pickup truck box. The former requires permanent modifications to the truck and the latter places the fulcrum for the sampler several feet above the ground for relatively unstable support. Not only is the height of the fulcrum excessive but also the truck box is connected to the frame by rubber mounts which permit at least limited flexing of the box relative to the light truck frame.

Accordingly, a primary object of the invention is to provide an under frame tool bar attachment for a light truck for supporting a soil sampler or another implement.

Another object is to provide an under frame tool bar attachment for a light truck which enables removal of the tool bar when not in use.

Another object is to provide an under frame mounted soil sampler for a light truck so as to afford improved stability.

Another object is to provide an under frame mounted soil sampler which minimizes height requirements for even a deep sampling tool.

Another object is to provide a soil sampler which may be securely supported on a light truck without modifying the truck, thereby to maintain the original appearance and resale value.

Another object is to provide a truck mounted soil sampler which is operative for deep sampling in even hard frozen ground.

Another object is to provide a truck mounted soil sampler which is easily operated by one man to collect multiple samples.

Finally, another object is to provide an under frame mounted soil sampler which is simple and rugged in construction, and efficient in operation.

SUMMARY OF THE INVENTION

The under frame tool bar attachment for a light truck according to the invention includes an elongated tool bar, a hanger assembly for suspending the tool bar in horizontal transversely extended relation across the underside of a light truck frame, means for securing the hanger assembly to the truck frame and fasteners for detachably securing the tool bar to the hanger assembly. A pair of hanger assemblies may be provided with each one including a top cross member adapted for rigid securement to a respective frame sidebar and a U-shaped hanger including a pair of depending legs and a bottom bracket extended between the lower ends of the legs for supporting the tool bar. U-bolts may be provided for securing the tool bar at a selected transverse position relative to the hangers.

The under frame mounted soil sampler includes an upright outer mast having a lower end adapted for securement to the under frame tool bar attachment in load bearing relation thereon. The upper end of the outer mast is stabilized by a vertically adjustable non-load bearing connection to a secondary frame secured on the top of the pickup truck box. A drill head is mounted on the outer mast for vertical movement between raised and lowered positions and carries a depending soil sampler tool for penetration into the ground upon lowering of the drill head and for collection of a soil sample upon subsequent raising movement of the drill head and tool. The tool may be a power actuated drill for use in hard and frozen ground or a simple probe for use in soft ground. An inner mast may be vertically slidably mounted on the outer mast with the drill head operative to be raised and lowered relative to the inner mast, thereby to minimize the height requirements for even a soil sampler capable of deep sampling. A pair of double acting hydraulic cylinders connected in parallel afford simple yet effective power for raising and lowering the drill head for soil sampling operations. Flexible tension straps connected between the drill head and a sample receiving can assembly at the base of the unit assures that the can remains in ground engagement during the sampling operation to assure effective collection. An open topped collection can is pivotally mounted for easy dumping and a shield partially surrounds and extends upwardly from the can both for safety and to prevent contamination of the collected samples by foreign matter.

DESCRIPTION OF THE PREFERRED EMBODIMENT

Figure 1:
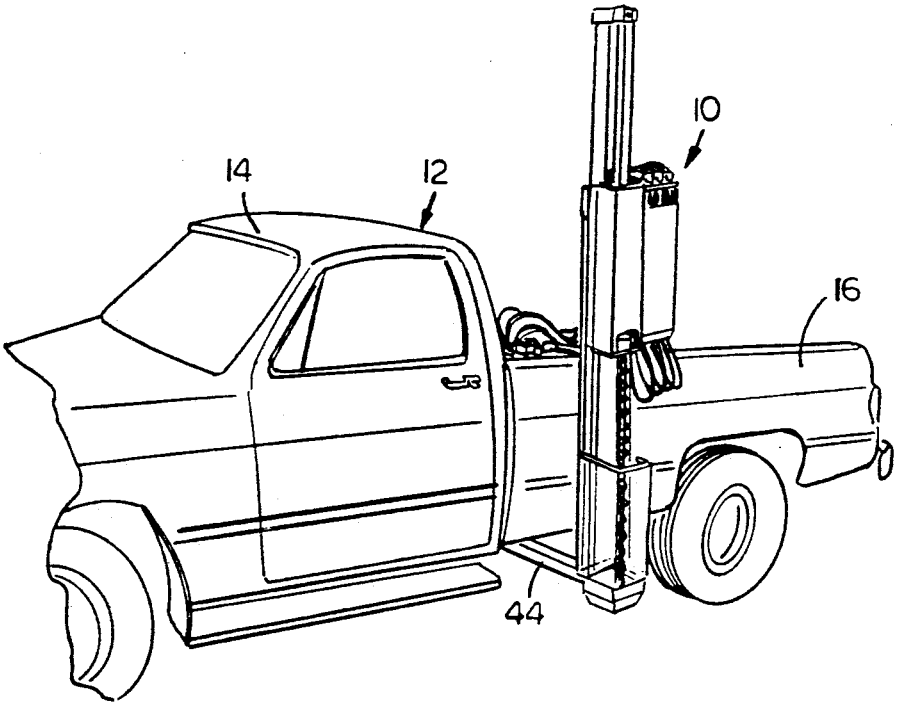
FIG. 1 is a perspective view of the under frame tool bar attachment and soil sampler of the invention mounted on a light truck.
Figure 3:
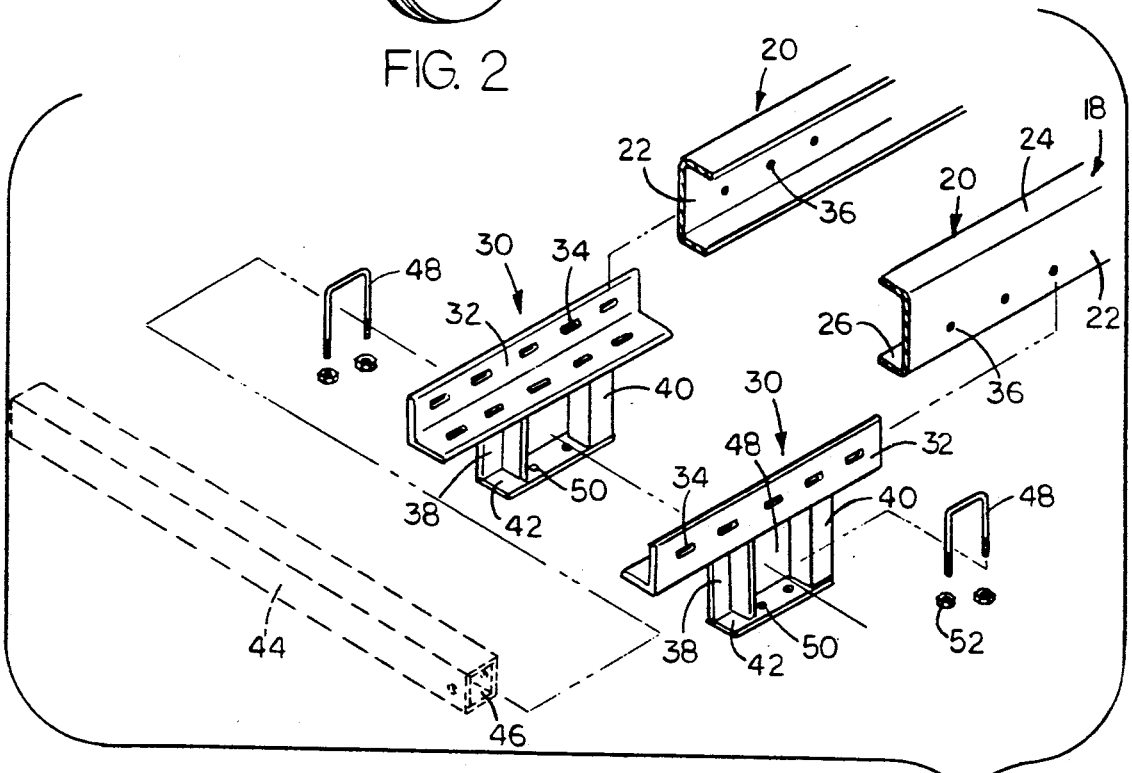
FIG. 3 is an exploded perspective view of the under frame mounted tool bar attachment of the invention.

The underframe mounted soil sampler 10 of the present invention is illustrated in FIG. 1, mounted on a light truck 12. A preferred type of truck for supporting the soil sampler is a 1 ton pickup truck equipped with 4-wheel drive although the invention may also be mounted on other and smaller light trucks. Truck 12 includes a cab 14 and box 16 mounted on a frame 18, a cut off portion of which is illustrated in FIG. 3 as including a pair of generally parallel elongated and transversely spaced apart sidebars 20. Each sidebar is an open-sided channel including an upright web 22 and inwardly directed upper and lower flanges 24 and 26.

Figure 2:
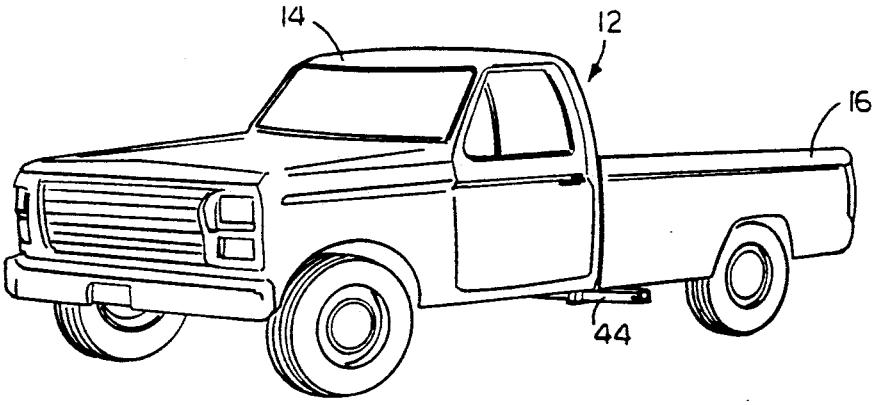
FIG. 2 is a perspective view of the truck mounted under frame tool bar attachment.

FIG. 2 illustrates the truck 12 with the underframe tool bar attachment 28 mounted thereon but with the soil sampler 10 removed.

Figure 4:
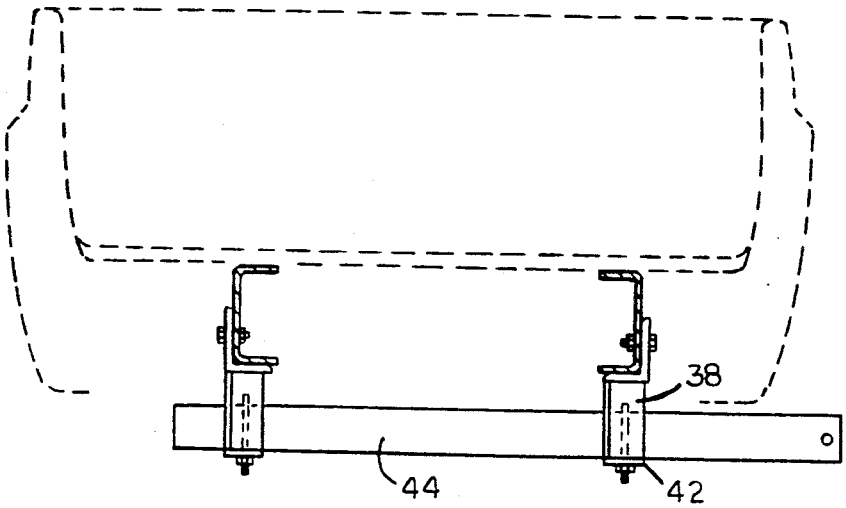
FIG. 4 is an end view of the under frame mounted tool bar attachment including the truck frame in section and the truck box in dotted lines.

Referring to FIGS. 3 and 4, tool bar attachment 28 includes a pair of mounting assemblies 30, each adapted for securement to a respective one of the frame sidebars 20. Each mounting assembly 30 includes a top cross member 32 which is illustrated in FIG. 3 as a length of angle-section metal strip with interior surfaces adapted for engagement against the web 22 and lower flange 26 of a respective sidebar 20. The top cross members 32 may be welded to the frame sidebars or securely bolted thereto with a plurality of bolts adapted for insertion through slots 34 and aligned holes 36 which may be drilled through the frame sidebar web 22 as illustrated in FIG. 3. The mounting assembly furthers includes a U-shaped hanger which comprises a pair of generally upright legs 38 and 40, also illustrated as angle section strips, and a bottom bracket 42 extended between the legs 38 and 40 for supporting the square section tool bar 44 as shown in FIGS. 3 and 4. Bottom bracket is preferably welded to the legs 38 and 40 which are likewise preferably welded to the top cross members 32.

Tool bar 44 is preferably a length of square section tubing having a flat bottom wall 46 adapted to rest on the bottom brackets 42 when the tool bar is fit through the center openings 48 in generally horizontal transversely directed relation therethrough. The tool bar is length adjustable in the transverse direction to accommodate connection to various implements. Upon selection of the desired position, a pair of U-bolts 48 releasably lock the tool bar to the bottom brackets 42. Each U-bolt is inserted through bottom bracket holes 50 and secured therein with nuts 52. Vertical adjustment of the tool bar 44 can be accomplished by inserting one or more shims between the tool bar 44 and bottom bracket 42 prior to tightening the U-bolts 48.

Figure 5:
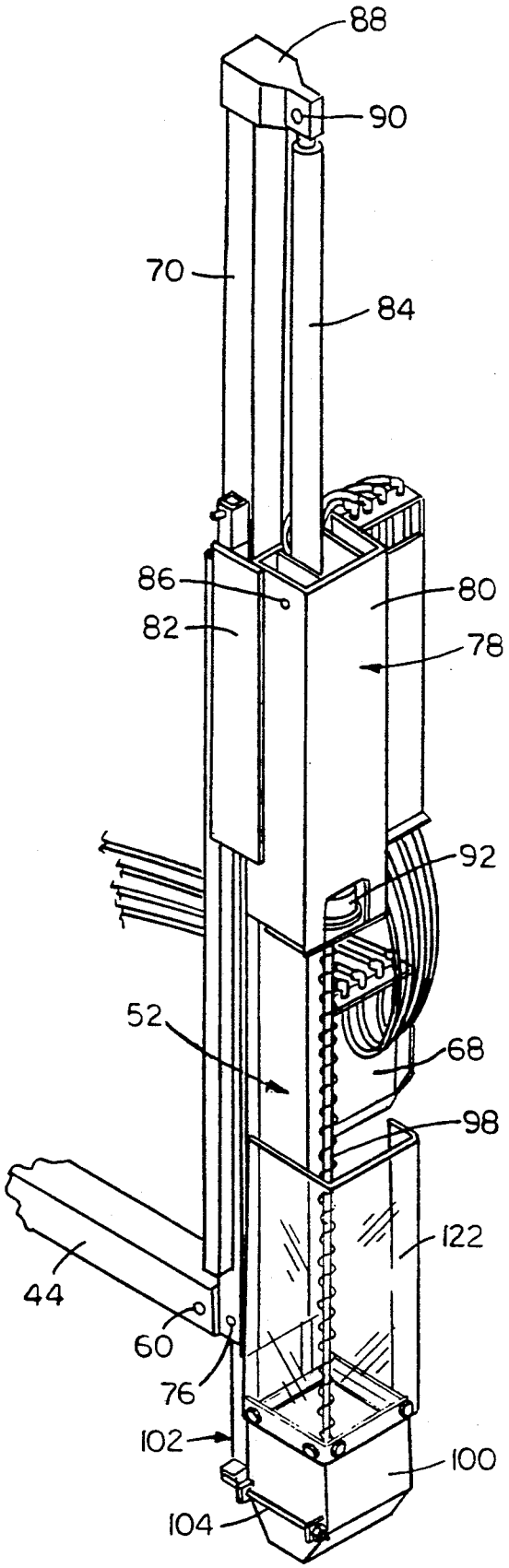
FIG. 5 is a perspective view of the under frame mounted soil sampler of the invention.
Figure 6:
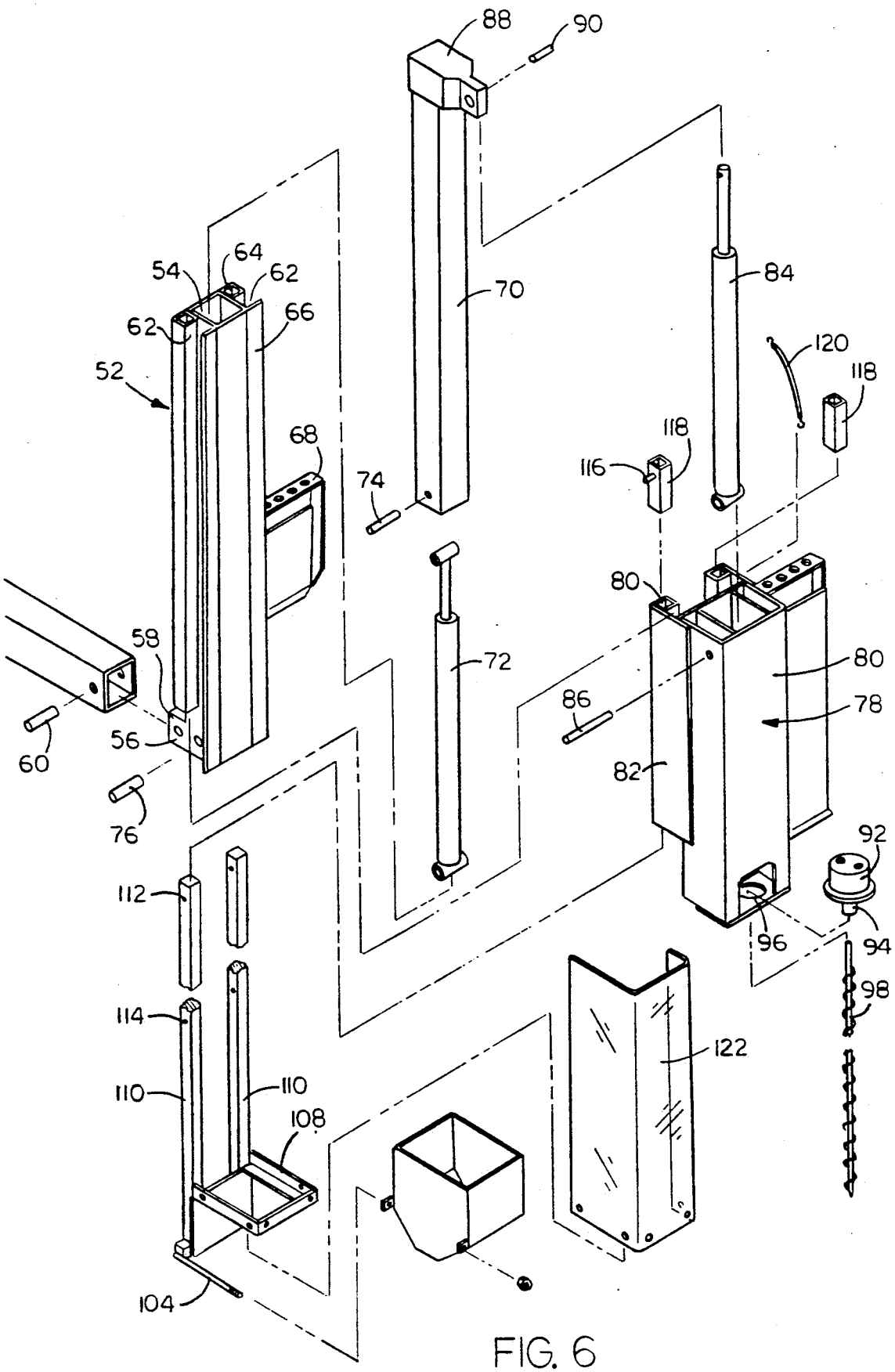
FIG. 6 is an exploded perspective view of the soil sampler.

The underframe-mounted soil sampler 10 is illustrated in FIGS. 5 and 6 as including an elongated upright outer mast 52 having upper and lower ends 54 and 56. The lower end includes a horizontally extended square section foot 58 adapted for telescopic reception in the open end of tool bar 44 for securement thereto by pin 60. Outer mast 52 is likewise constructed as a length of square section tubing but with a pair of guide channels 62 formed on opposite sides thereof by tubing 64 and outer flanges 66. A hydraulic hose harness 68 protrudes from one side of the outer mast 52.

An elongated upright inner mast 70 is telescopically slideable within the center channel of outer mast 52. A first hydraulic cylinder 72 has its upper end connected to the lower end of inner mast 70 by pin 74 and its lower end connected to the bottom of outer mast 52 by pin 76. Accordingly, the inner mast 70 is raised and lowered with respect to outer mast 52 in response to extension and retraction of first hydraulic cylinder 72.

A drill head 78 is mounted on outer mast 52 for up and down vertical movement between raised and lowered positions. The illustrated drill head 78 is constructed from rectangle section tubing 80 having a pair of inwardly directed flanges 82 having the 1¼ inch square section tubing fixed on the interior surface thereof by welding or the like. The tubing 80 is slideably received within the guide channels 62 of outer mast 52. To support the drill head 78 thereon, a second hydraulic cylinder 84 has its lower end connected to the drill head 78 by pin 86 and its upper end connected to a top bracket 88 on inner mast 70 by pin 90. The drill head 78 is therefore raised and lowered relative to inner mast 70 in response to extension and retraction of second hydraulic cylinder 84.

A hydraulic motor 92 equipped with a chuck 94 is supported in the base of drill head 78 in an opening 96 for releasably receiving the upper end of a soil sampling drill bit 98.

Figure 7:
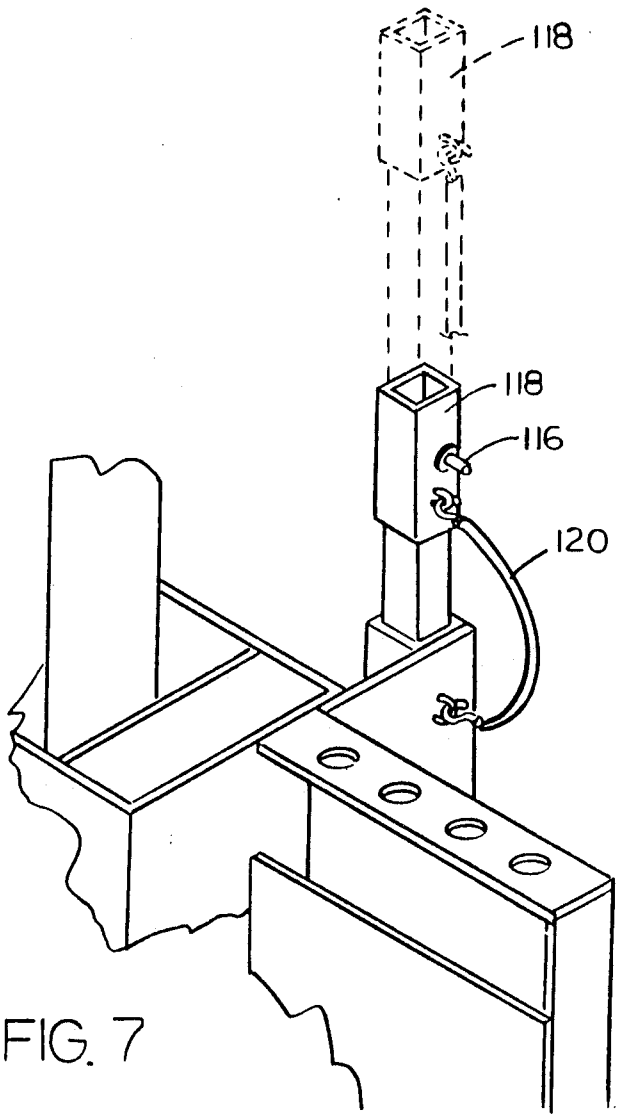
FIG. 7 is an enlarged perspective view showing the cooperative engagement of the drill head with the can assembly.
Figure 8:
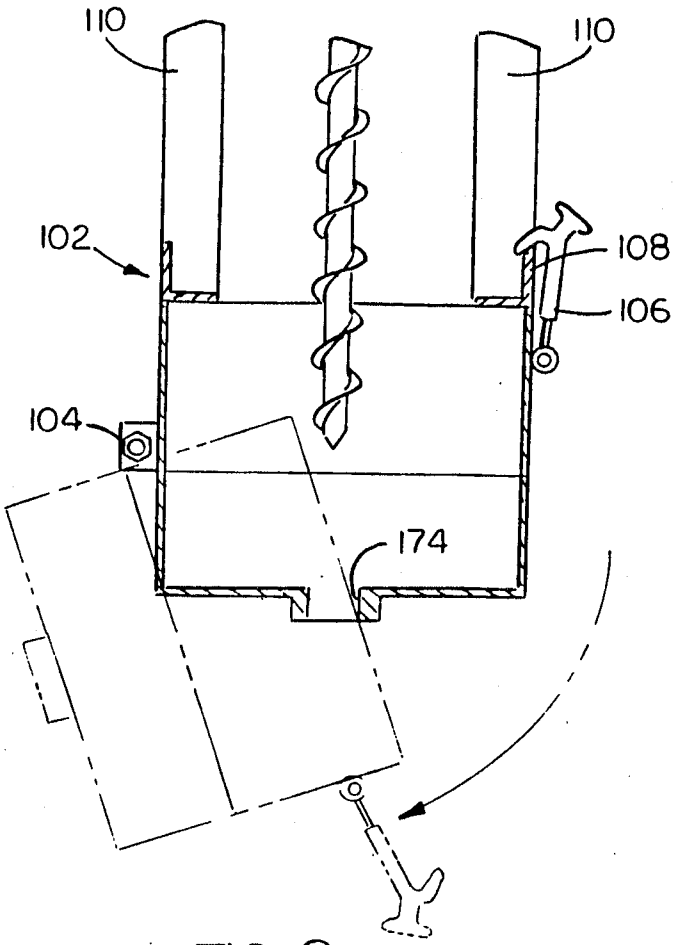
FIG. 8 is a side sectional view of a lower portion of the can assembly with dotted lines indicating pivotal lowering of the can.

Upon lowering of the drill head 78 and rotation of drill bit 98 by hydraulic motor 92, soil is drawn upwardly for collection within an open-topped can 100 of a can assembly 102 referring to FIGS. 6 and 8. Can 100 is pivotally supported on a transverse horizontal shaft 104 at the base of can assembly 102. The can tends to fall downwardly by gravity as indicated by dotted lines in FIG. 8 but can be releasably supported in its raised soil collecting position of FIG. 8 by an extendable hook 106 engageable with a top rim 108. A pair of guideposts 110 extend upwardly from can 100 for telescopic reception within the tubing 80 of drill head 78. Each guidepost has a top hole 112 adjacent to the upper end thereof and a lower hole 114 at an intermediate position therealong for releasably receiving the spring plunger 116 of a stop channel 118. Upon extension of the guideposts 110 through the drill head tubing 80 and connecting the stop channels 118 to the guideposts, the can assembly 102 is carried on the drill head and prevented from falling therefrom by engagement of the stop channels 118 with the upper ends of the drill head tubing 80. An expandable tension cord 120 is connected between the stop channel 118 and drill head 78, as shown best in FIG. 7, for maintaining the can 100 in ground engagement upon lowering of the drill head, as described in further detail below.

An upstanding generally U-section transparent shield 122 is mounted on the can assembly top rim 102 both for blocking access to the raised can for the operator's safety and for preventing foreign matter from blowing into the collected soil and contaminating the sample. Shield 122 is preferably made of a plastic material such as Lexan to further prevent contamination of the soil sample. It is thought that rust from a steel can and zinc from a galvanized can could contaminate soil samples collected in cans formed of those materials.

Figure 9:
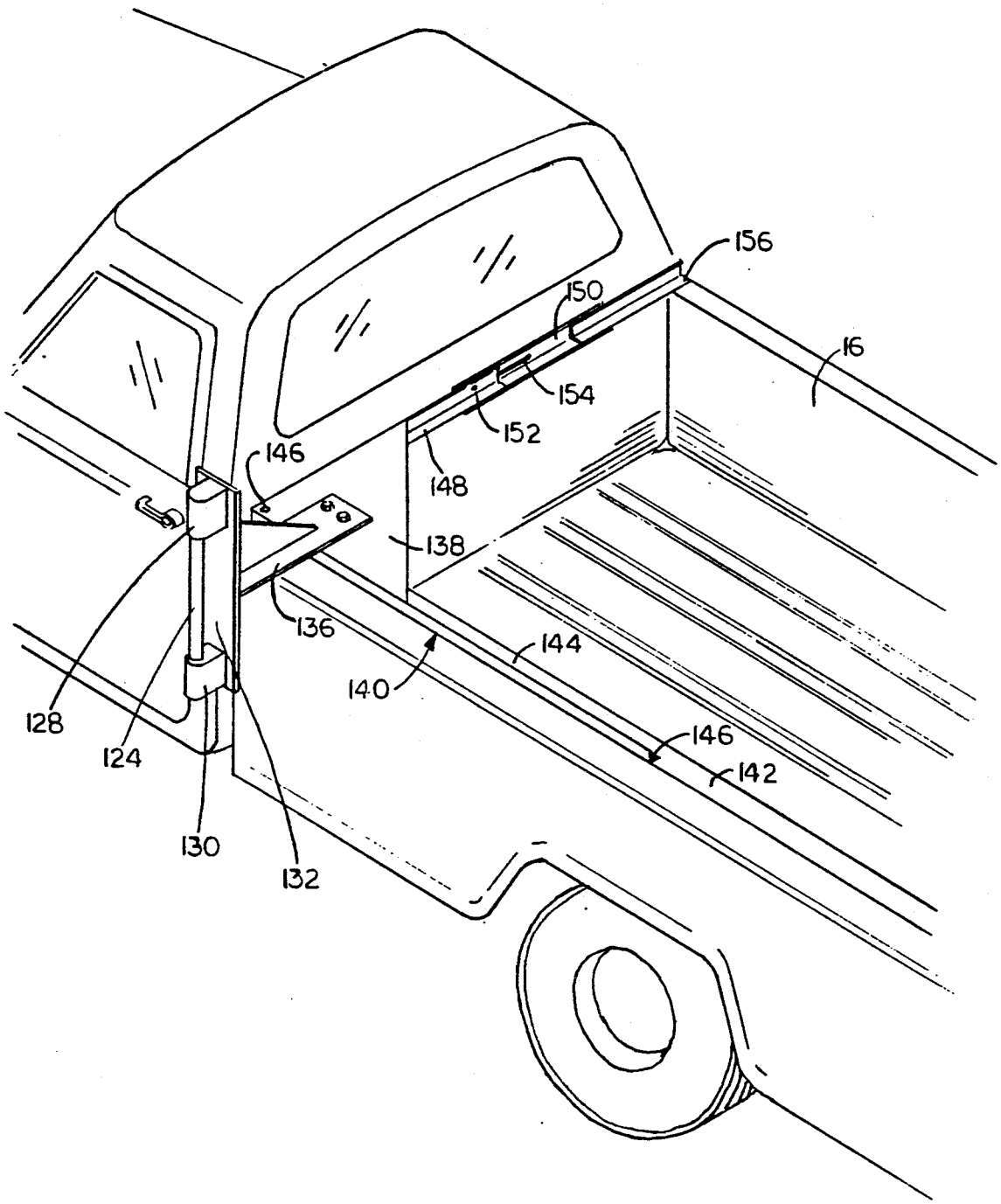
FIG. 9 is a perspective view of the truck box mounted secondary frame for non-load bearing stabilizing of the soil sampler.
Figure 13:
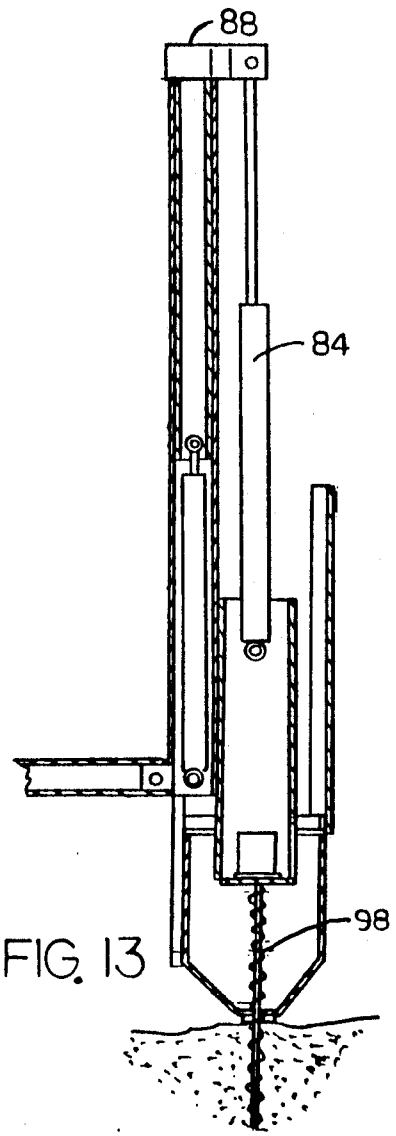
FIG. 13 is a side sectional view of the soil sampler showing the drill head further lowered and with dotted lines indicating a fully lowered position of the drill head.
Figure 12:
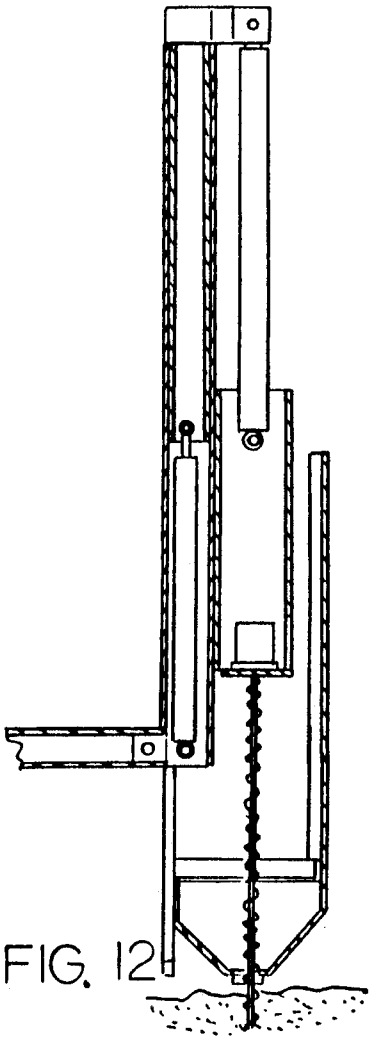
FIG. 12 is a side sectional view of the soil sampler with the drill head partially lowered and the can in ground engagement.
Figure 11:
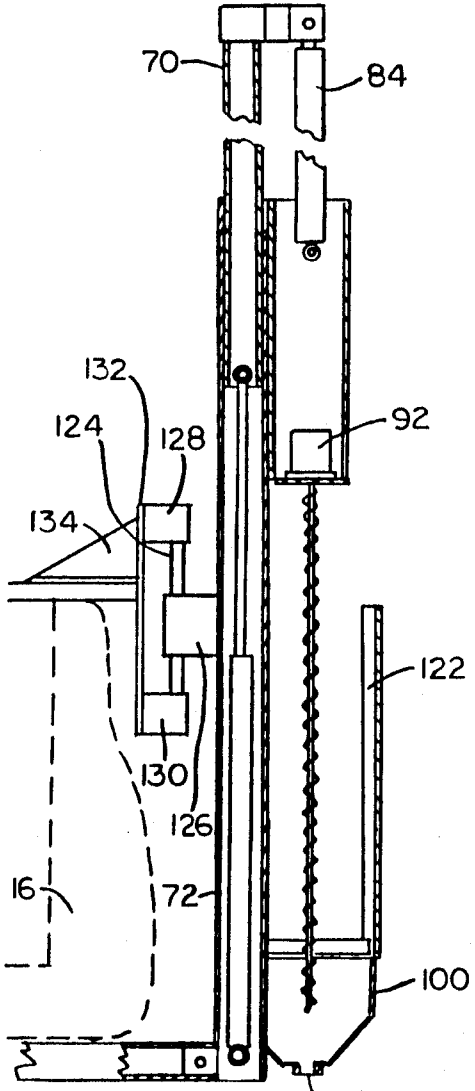
FIG. 11 is a foreshortened side sectional view of the soil sampler equipped with a deep sampling bit and with the drill head and soil sampling can in the raised transport positions thereof.

Whereas substantially all of the weight of soil sampler 10 is borne by tool bar 44, an upright stabilizer post 124, as illustrated in FIGS. 9 and 11, is provided to stabilize the soil sampler against fore and aft and transverse movement. A collar 126 is welded or otherwise secured on the inner surface of outer mast 52 for receiving stabilizer post 124. The post is removably secured between upper and lower post collars 128 and 130 on the outer face of vertical plate 132 which is mounted by a gusset 134 on the outer end of horizontal mounting plate 136. Plate 136 is bolted or otherwise secured onto a horizontal valve board 138 at one corner of the universal truck box toprail-supported frame 140. The stabilizer post 124 is substantially taller than the outer mast collar 126 to accommodate mounting of the soil sampler on trucks having different vertical dimensions from the underside of the frame to the top surface of the truck box toprails 142.

Universal frame 140 includes an elongated leg 144 having bolt holes aligned with the top rail stake holes for securement thereto by bolts 146 having expandable fasteners thereon for securing leg 144 on toprail 142 without any defacement or machining of the original truck box. Likewise, a perpendicularly extended leg 148 is provided with a length-adustable extension 150 connected thereto by a pin 152 and slot 154 connection for aligning end bolt 156 with the front stakehole on the opposite side of the box 16. The length-adjustable leg 148 accommodates connection to truck beds of different width.

Figure 10:
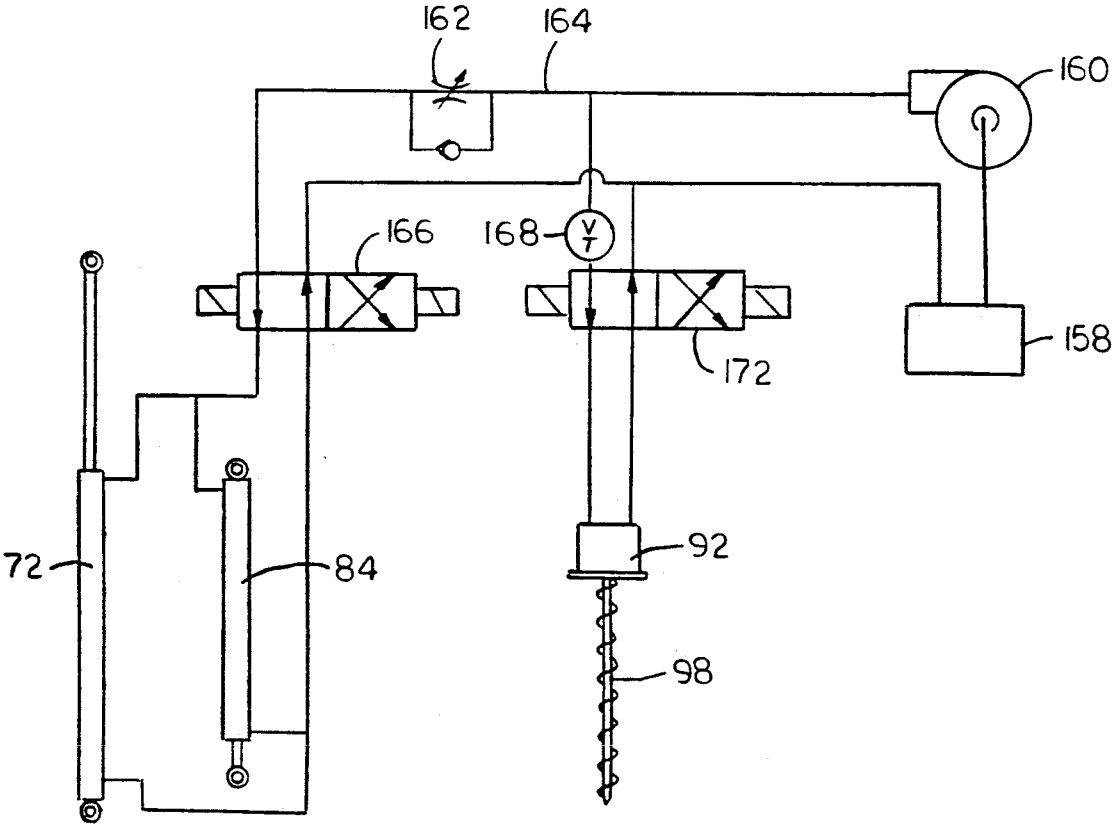
FIG. 10 is a hydraulic circuit diagram for the soil sampler.

The hydraulic circuit for controlling the operation of first and second hydraulic cylinders 72 and 84 and hydraulic motor 92 is illustrated in FIG. 10. Hydraulic fluid in a reservoir 158 is pressurized by pump 160 which may be connected to the truck engine by an electrically actuated clutch or which may be independently powered as part of a portable unit including an internal combustion engine for driving the pump. A flow control valve 162 is provided along the pressure line 164 to cylinders 72 and 84 to adjust the rate at which the drill head 78 is raised and lowered. An electrically activated solenoid valve 166 simultaneously actuates both hydraulic cylinder 72 and 84 since they are connected and parallel. Solenoid switch 166 is preferably a momentary rocker switch biased to a central off position. Another flow control valve 168 is interposed along the pressure line 170 to solenoid valve 172 for adjusting the speed of rotation of the drill bit. Solenoid valve 172 controls actuation of the drill head motor 92 and is likewise preferred to be a momentary switch biased to an off position when released by the operator.

In operation, truck 12 is driven to a soil sampling site with the drill head 78 and can assembly 102 in the raised position as illustrated in FIG. 11. Upon actuation of first and second cylinders 72 and 84 to lower the drill head, the can assembly 102 is lowered by gravity into ground engagement. As the drill head proceeds downwardly relative to the ground engaged can assembly, tension cords 120 are stretched to exert a downward biasing force on the can assembly through its guideposts 110 to assure that the can post remains in ground engagement when the drill bit is to be raised. The drill bit is aligned with an extension through an opening 174 in the bottom wall of can 100. A drill bit of a length sufficient for taking a 40 inch soil sample has been successfully used in the soil sampler 10 of the invention. The soil sample collects with the can 100 as the first and second cylinders 72 and 84 are reversed for raising the drill head. As the drill head engages the stop channels 118 on the can assembly guideposts 110, further raising movement of the drill head effectively lifts the can assembly from the ground to its transport position of FIG. 11. When only shallow sampling is required, the stop channels 118 may be adjusted downwardly on the guideposts to have the spring plungers 116 thereof snap into the lower guidepost hole 114. Accordingly, the drill head will lift the can assembly out of ground engagement without the necessity of travelling the full extent required for withdrawing a long drill bit from the ground.

Whereas the soil sampler 10 has been described in connection with a preferred embodiment thereof, it is understood that many modifications, substitutions and alternatives can be made which are within the intended broad scope of the appended claims. For example, whereas the combination outer mast 52 and inner mast 70 with tandem hydraulic cylinders 72 and 84 are preferred for minimizing the required height of the soil sampler without compromising on the range of movement for the drill head, a unit intended only for shallow sampling may be simplified by combining the outer and inner masts 52 and 70 into a single rigid member.

Likewise, whereas the power actuated drill bit 98 is preferred for sampling even hard frozen soil, units intended for use in only soft soil may eliminate the hydraulic motor 92 and drill bit 98 and replace them with a conventional soil sampling probe.

Furthermore, the apparatus of the invention is useful for purposes other than taking soil samples. For example, the underside of the drill head of the invention could be equipped with a tamping plate for driving fenceposts into the ground or the receiving sleeves for the breakaway posts of modern highway signs.

Additional functions can be easily incorporated into the apparatus of the invention. By providing an arrow on the drill head which lines up with a vertical gauge on the stationary outer mast 52, a depth gauge is afforded for accurately measuring the depth of sampling.

Furthermore, the apparatus could be equipped with a pressure gauge on the pressure line 164 to hydraulic cylinders 72 and 84 for use with the depth gauge for locating the plow pan below the surface of the ground. The pressure will be increased upon engagement of the drill bit with the plow pan and will remain elevated until such time as the drill bit breaks through the plow pan. The depth of the drill bit at both pressure changes will provide a measurement of the depth and thickness of the plow pan.

Thus there has been shown and described an under-frame mounted tool bar for light trucks which accomplishes at least all of the stated objects.

What is claimed is:

1. An under-frame tool bar attachment for a light truck including a frame having a pair of generally parallel elongated and transversely spaced apart frame side bars and a cab and box supported on said frame, said attachment comprising, an elongated tool bar, tool bar mounting means operative to suspend said tool bar in generally horizontal transversely extended relation across the under side of said light truck frame, securement means or securing said mounting means to a light truck frame, and, lock mean for securing said tool bar to said mounting means, said tool bar mounting means comprising a pair of mounting assemblies, each adapted for securement to a respective one of said frame side bars.

2. The tool bar attachment of claim 1 wherein each mounting assembly comprises a U-shaped hanger including a pair of generally upright legs and a bottom bracket connected to and extended between said legs for supporting the tool bar thereon.

3. The tool bar attachment of claim 2 wherein each mounting assembly further comprises a top cross member connected to an extended between upper ends of aid legs for securement to said frame side bar.

4. The tool bar attachment of claim 3 wherein said top cross member comprises an elongated generally L-section strip for engagement with two adjacent surfaces of a frame side bar.

5. The tool bar of claim 4 wherein said securement means comprises a plurality of nuts and bolts and longitudinally spaced apart holes in said top cross member for alignment with matched holes through said frame side bar and receipt of said bolts therethrough.

6. The tool bar of claim 4 wherein said securement means comprises an elongated edge of said top cross member, said edge adapted to be welded to said frame side bar.

7. The tool bar of claim 2 wherein said lock means comprises a U-bolt, said bottom bracket having a pair of holes arranged for receiving said U-bolt to clamp said tool bar to said bottom bracket.

8. The tool bar attachment of claim 7 further comprising shim means adapted for placement between said tool bar and bottom bracket for limited vertical adjustment of said tool bar.

9. In combination, a light truck including a frame having a pair of generally parallel elongated and transversely spaced apart from side bars, and a cab and box supported on said frame, and an under frame to bar attachment comprising, an elongated tool bar, tool burst mounting means operative to suspend said tool bar in generally horizontal transversely extended relation across the underside of said light truck frame, securement means or securing said mounting means to said light truck frame, and lock means or securing said tool bar to said mounting means, said tool bar mounting means comprising a pair of mounting assemblies, each adapted for securement to a respective one of said fame side bars.

10. An under frame mounted soil sampler for a light truck including a frame and a cab and box supported on aid frame, said soil sampler comprising, an elongated upright outer mast having upper and lower ends, under frame tool bar attachment means adapted for securement o said light truck frame, means or supporting the lower end of said route roast on said under frame tool bar attachment means in load bearing relation thereon, stabilizer means for stabilizing the upper end of said outer mast against transverse and fore and aft movement relative to said light truck box, a drill head mounted on said outer mast for up and down vertical movement between raised and lowered positions, power mean for raising and lowering said drill head between said raised and lowered positions, a soil sampler tool removably mounted on said drill head and extended downwardly therefrom for penetration into the ground upon movement o the drill head to the lowered position thereof, and operative to collect a soil sample upon subsequent raising movement of the drill had to the raised position thereof, and an inner mast vertically movably support on said route remast, said power means comprising first power means connected to and extended between said outer mast and inner mast for raising and lowering said inner mast relative to said outer mast and second power means connected to and extended between said inner mast and said drill head for raising and lowering said drill head relative to said inner mast.

11. The soil sampler of claim 10 wherein said first and second power means comprise double acting hydraulic cylinders.

12. The soil sampler of claim 11 wherein said power means further comprises a source of hydraulic fluid under pressure and said first and second power means being connected to said source in parallel.

13. The soil sampler of claim 10 wherein said soil sampler tool comprises and elongated drill bit and said drill head further comprises a chuck for removably receiving said drill bit and a third power means for rotating said chuck.

14. The soil sampler of claim 13 wherein said third power means comprises a hydraulic motor.

15. The soil sampler of claim 13 wherein said outer mast and drill head further comprise respective hydraulic hose harnesses and a plurality of hydraulic hoses connected to and extended between said harnesses or permitting vertical reciprocal movement of said rill head while maintaining communication between said second and third power means and a source of hydraulic fluid under pressure.

16. The soil sampler of claim 10 wherein said soil sampler tool comprises a soil sampling probe.

17. The soil sampler of claim 10 wherein said under frame tool bar attachment means comprises a elongated tool bar, tool ar mounting means operative to suspend said tool bar in generally horizontally transversely extended relation across the underside of a light truck frame, securement means or securing said mounting means to a light truck frame, and lock means for securing said tool bar to said mounting means.

18. An under frame mounted soils ampler for a light truck including a frame and act and box supported on said frame, said soil sampler comprising, an elongated upright outer mast having upper and lower ends, under frame tool ar attachment means adapted for securement to said light truck frame, means or supporting the lower end of said outer mast on said under frame tool bar attachment means in load bearing relation thereon, stabilizer means for stabilizing he upper end of said outer mast against transverse and for and aft movement relative to said light truck box, a drill head mounted on said outer mast for up and down vertical movement between raised and lowered positions, power means or raising and lowering said rill head between said raised and lowered positions, a soil sampler tool removably mounted on said drill had and extended downwardly therefrom for penetration into the ground upon movement o the drill head to the lowered position thereof, and operative to collect a soil sample upon subsequent raising movement o the drill head to the raised position thereof, a soil sample collecting can assembly vertically slidably supported on said outer mast, and coacting abutment means onsaid can assembly and drill head operative to raise said can assembly to a raised position in ground clearance relation in response to upward movement of the drill head to the raised position thereof, said can assembly being lowered into ground engagement upon lowering movement of the drill head whereupon continued lowering movement of he drill had is operative to lower the soil sampler tool relative to said ground engaged can assembly, said can assembly including an open topped can having a bottom wall with an opening therethrough, said soil sampler tool being aligned with said opening for vertical movement therethrough.

19. The soil sampler of claim 18 wherein said open topped can is supported for pivotal movement between a raised sample collecting position and a lowered sample dumping position, ad further comprising means or releasable securing said can in the raised position thereof.

20. The soil sampler of claim 18 further comprising a protective shield positioned to generally partially surround said can in the raised position thereof and to extend upwardly therefrom for blocking access to said soil sampler tool and shielding said can from the entry of foreign mater unassociated with a soil sample collected by said tool.

21. The soil sampler of claim 18 further comprising biasing mean for urging said can assembly into ground engagement upon lowering movement of the soil sampler tools relative to the ground engaged can assembly.

22. The soil sampler of claim 21 wherein said biasing means comprises an elongated tension member connected to and extended between said rill had an can assembly.

23. The soil sampler of claim 22 wherein said can assembly includes and open topped can and at least one guide post extended upwardly from said can through said drill head, said tension member being connected to an upper end of said guide post above said drill head.

24. An under frame mounted soil sampler for a light truck including a frame and a ca band box supported on aid frame, said soil sampler comprising, an elongated upright outer mast having upper and lower ends, under frame tool bar attachment means adapted for securement to said light truck frame, means for supporting the lower end of said outer mast on said under frame tool bar attachment means in load bearing relation thereon, stabilizer means for stabilizing the upper end of said outer mast against transverse and fore and aft movement relative to said light truck box, a drill head mounted on said outer mast for up and down vertical movement between raised and lowered positions, power mean for raising and lowering said drill head between aid raised and lowered positions, and a soil sampler tool removably mounted onsaid drill head and extended downwardly there form for penetration into the ground upon movement of the drill head t the lowered position thereof, and operative to collect a soil sample upon subsequent raising movement o the drill had to he raised position thereof;

said stabilizer means comprising a secondary frame adapted for connection to the light truck box, an upright stabilizer post mounted on one of said secondary frame and outer mast and a collar slidably supported on said post and secured to the other of said secondary frame and outer mast.

25. An under frame mounted soil sampler for a light truck including a frame and a cab and box supported on said frame, said soil sampler comprising, an elongated upright outer mast having upper and lower ends, under frame tool bar attachment means adapted for securement to said light truck frame, said under frame tool bar attachment means including an elongated tool bar, tool bar mounting means operative to suspend said tool bar in generally horizontal transversely extended relation across the under said of said light truck frame, said tool bar mounting means comprising a pair of mounting assemblies, each adapted for securement to a respective one of said frames side bars, securement means for securing said mounting means to a lightly truck frame, and, lock means for securing said tool bar to said mounting means, means or supporting the lower end of said outer mast on said tool bar in load bearing relation thereon, stabilizer means or stabilizing the upper end of said outer mast against transverse and fore and aft movement relative to said light truck box, a drill head mounted on said outer mast for up and down vertical movement between raised and lowered positions, power means or raising and lowering said rill head between said raised and lowered positions, and a soil sampler tool removably mounted on said drill head and extended downwardly therefrom for penetration into the ground upon movement of the drill head o the lowered position thereof, and operative to collect a soil sample upon subsequent raising movement of the drill head to the raised position thereof.

* * * * *